US010913644B2

(12) United States Patent
Maroney, Sr. et al.

(10) Patent No.: US 10,913,644 B2
(45) Date of Patent: Feb. 9, 2021

(54) PLUG-REMOVING TOOL

(71) Applicants: Donald Kenneth Maroney, Sr., Livermore, CA (US); Barbara Goode Maroney, Livermore, CA (US)

(72) Inventors: Donald Kenneth Maroney, Sr., Livermore, CA (US); Barbara Goode Maroney, Livermore, CA (US)

( * ) Notice: Subject to any disclaimer, the term of this patent is extended or adjusted under 35 U.S.C. 154(b) by 701 days.

(21) Appl. No.: 15/451,386

(22) Filed: Mar. 6, 2017

(65) Prior Publication Data

US 2018/0251356 A1 Sep. 6, 2018

(51) Int. Cl.
*B67B 7/04* (2006.01)

(52) U.S. Cl.
CPC ..... *B67B 7/0429* (2013.01); *B67B 7/04* (2013.01)

(58) Field of Classification Search
CPC ..... B67B 7/0429; B67B 7/04
USPC ..... 29/219; 81/3.09, 3.29, 3.36, 3.37, 3.47, 81/3.48, 3.56, 177.2, 177.6, 28; 7/155
See application file for complete search history.

(56) References Cited

U.S. PATENT DOCUMENTS 786,492 A * 4/1905 Garimaldi ..... B67B 7/0429 81/3.09
4,458,562 A * 7/1984 Jackson ..... B25B 13/14 188/67
5,421,180 A * 6/1995 Rojdev ..... B25G 1/005 70/456 R
5,992,269 A * 11/1999 Puig ..... B67B 7/0429 81/3.35
8,281,437 B2 * 10/2012 Hunkele ..... B26B 11/001 7/118
2001/0040911 A1 * 11/2001 Rubenstein ..... G01K 1/14 374/141
2008/0108950 A1 * 5/2008 Rioux ..... A61M 39/0208 604/181
2009/0301261 A1 * 12/2009 Cellini ..... B67B 7/04 81/3.45
2012/0005838 A1 * 1/2012 Ellington ..... B67B 7/0429 7/155
2013/0269486 A1 * 10/2013 Gasman ..... B67B 7/0429 81/3.37

* cited by examiner

*Primary Examiner* — Lee D Wilson
*Assistant Examiner* — Seahee Hong
(74) *Attorney, Agent, or Firm* — Gerald R. Prettyman

(57) ABSTRACT

This invention provides a novel solution for a Plug-Removing Tool comprising a base, a helicoid tool, and a lever. The invention also includes a method for using a Plug-Removing Tool to remove a plug from an opening of a container comprising partially inserting a helicoid tool of the Plug-Removing Tool into the plug, extending a lever of the Plug-Removing Tool, gripping the lever with a hand and using the lever to apply a torque relative to a point where the helicoid tool was inserted into the plug driving the helicoid tool into the plug, and using the Plug-Removing Tool, with the helicoid tool fully inserted into the plug, to pull the plug from the container.

11 Claims, 7 Drawing Sheets

PLUG-REMOVING TOOL

FIELD OF THE INVENTION

This invention relates generally to the field of a Plug-Removing Tool, and specifically a Plug-Removing Tool used for removing a plug from an opening in a container such as a cork from a bottle.

BACKGROUND OF THE INVENTION

A considerable amount of people use consumable fluids, such as wine or vinegar that require opening by removing a sealing plug from an opening in a container. The fluid is typically sealed within the container with a plug at an opening in the container. For example, wine is typically preserved within a bottle by a cork inserted into the opening of the bottle. Removing the cork requires twisting a corkscrew into the cork and using a significant amount of force to pull the cork out of the bottle. The force required to twist the corkscrew into the cork and pull the cork out of the bottle can be so significant that some adults are unable to do so without using a cork-removing tool, such as a wine bottle opener. The amount of force required to insert the corkscrew into the cork and pull the cork out of the bottle may also cause physical injuries to an adult such as muscle strains and carpel tunnel syndrome. The problem may further be exasperated by increased repetition. For example, bartenders and sommeliers are required to open many bottles over a period of time. Alone, or in combination with repetition, removing the cork from a bottle requires a significant amount of force and may result in physical injuries.

The fundamental design of most cork-removing tools includes a handle, corkscrew, and various ancillary tools (e.g. a knife, key ring, etc.). There are more fanciful types of cork-removing tools that use motors and larger levers in attempts to make it easier to remove plugs from containers (i.e. a cork from a bottle). However such fanciful types of cork-removing tools are often bulky, require complex moving parts (i.e. motors, controllers, and batteries), expensive, and not suitable to be carried (e.g. in the pocket of a sommelier). Thus, there is a need for a simple, cost friendly tool for removing a plug from a container (i.e. a cork from a wine bottle).

This invention provides a novel solution including a Plug-Removing Tool that includes a base, corkscrew, lever, and ancillary tools and methods for removing a plug from a container.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

SUMMARY

Figure 1:
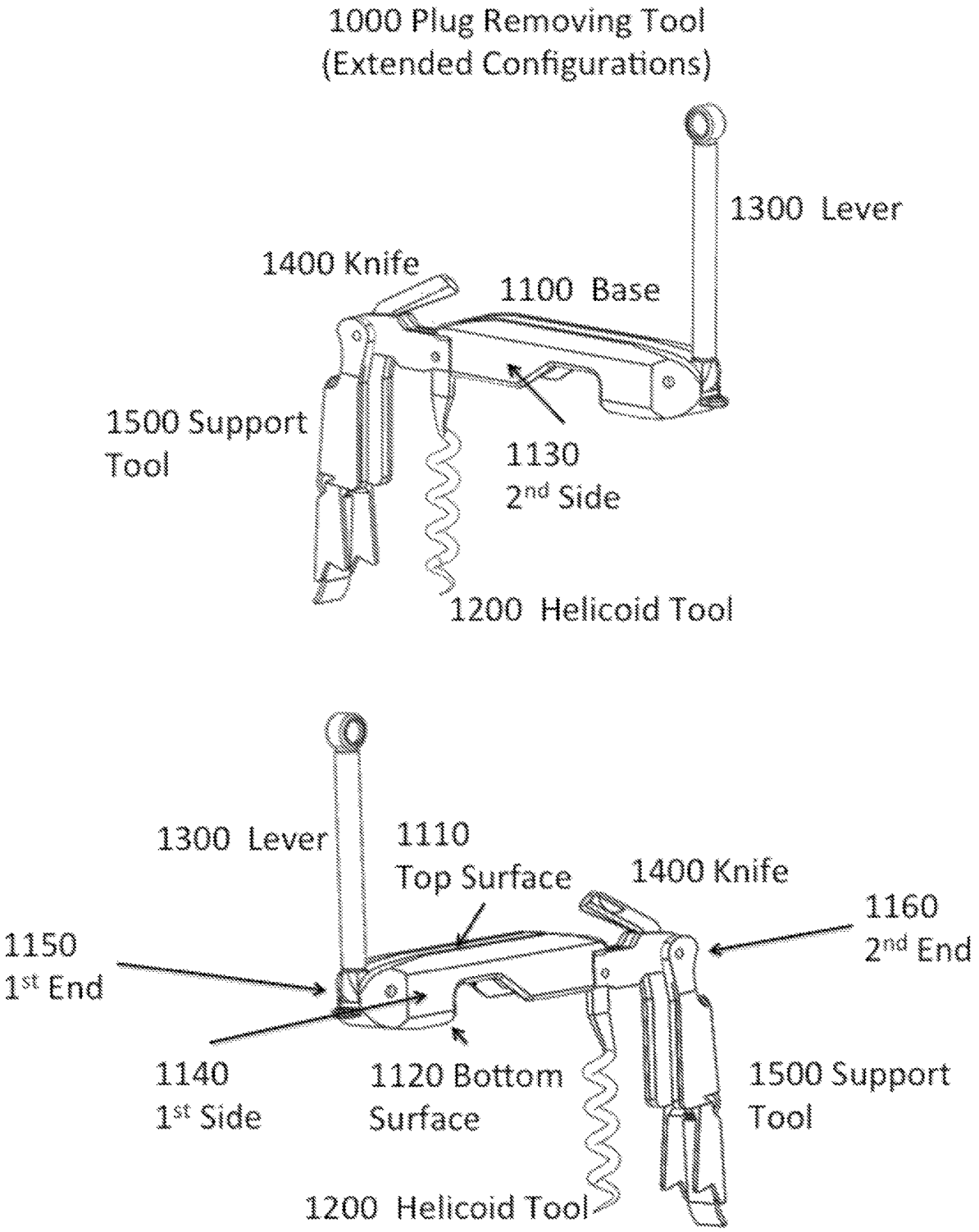
FIG. 1 is a diagram of an exemplary embodiment illustrating the Plug-Removing Tool in accordance with the teachings of the present invention.

The invention includes a 1100 base, a 1200 helicoid tool, and a 1300 lever. The 1100 base including a 1110 top surface, a 1120 bottom surface opposite the 1110 top surface, a 1140 first side surface, a 1130 second side surface opposite the 1140 first side surface, a 1150 first end, and a 1160 second end opposite the 1150 first end. The 1200 helicoid tool may be attached on the 1120 bottom surface of the 1100 base and near the 1160 second end of the 1100 base. The 1300 lever may be attached on the 1110 top surface of the 1100 base and at the 1150 first end of the 1100 base. The 1200 helicoid tool and the 1300 lever may be pivotally attached to the 1100 base enabling the 1200 helicoid tool and 1300 lever to be positioned in a stowed position when not in use and positioned in an extended position when in use. The 1000 Plug-Removing Tool may further include a 1500 support tool pivotally attached on the 1120 bottom surface of the 1100 base and near the 1160 second end of the 1100 base enabling the 1500 support tool to be hinged into a stowed position when not in use and hinged into an extended position when in use. The 1000 Plug-Removing Tool may further comprise a 1400 knife pivotally attached on the 1110 top surface of the 1100 base and at the 1160 second end of the 1100 base enabling the 1400 knife to be hinged into a stowed position when not in use and hinged into an extended position when in use. The 1300 lever may also include an 1310 arm and a 1320 sleeve. The 1150 first end of the 1310 arm is pivotally attached to the 1100 base enabling the 1300 lever to rotate from a stowed configuration into an extended configuration with the 1300 lever forming about a right angle relative to the 1100 base, and a 1160 second end of the 1310 arm including a stop feature to hold the 1320 sleeve. The 1320 sleeve may also be configured to rotate freely about the 1310 arm. The 1000 Plug-Removing Tool may also include a 1303 first spring configured to hold the 1300 lever and a 1503 second spring configured to hold the 1200 helicoid tool in the stowed and the extended configuration.

The invention may further include a 1000 cork-removing tool comprising a 1100 base, a corkscrew, and a 1300 lever. The 1100 base may include a 1110 top surface, a 1120 bottom surface opposite the 1110 top surface, a 1140 first side surface, a 1130 second side surface opposite the 1140 first side surface, a 1150 first end, and a 1160 second end opposite the 1150 first end. The corkscrew may be attached on the 1120 bottom surface of the 1100 base and near the 1160 second end of the 1100 base. The 1300 lever may be attached on the 1110 top surface of the 1100 base and at the 1150 first end of the 1100 base. The corkscrew and the 1300 lever may be pivotally attached to the 1100 base enabling the corkscrew and 1300 lever to be positioned in a stowed position when not in use and positioned in an extended position when in use. The 1000 cork-removing tool may also comprise a 1500 support tool pivotally attached on the 1120 bottom surface of the 1100 base and near the 1160 second end of the 1100 base enabling the 1500 support tool to be positioned in a stowed position when not in use and positioned in an extended position when in use. The 1000 cork-removing tool may also comprise a 1400 knife pivotally attached on the 1110 top surface of the 1100 base and at the 1160 second end of the 1100 base enabling the 1400 knife to be positioned in a stowed position when not in use and positioned in an extended position when in use. The 1300 lever may comprise an 1310 arm and a 1320 sleeve wherein a 1150 first end of the 1310 arm is pivotally attached to the 1100 base enabling the 1300 lever to rotate from a stowed configuration into an extended configuration with the 1300 lever forming about a right angle relative to the 1100 base, and a 1160 second end of the 1310 arm including a stop feature to hold the 1320 sleeve, and the 1320 sleeve is configured to rotate freely about the 1310 arm. The 1000 cork-removing tool may also include a 1303 first spring configured to hold the 1300 lever and a 1503 second spring configured to hold the corkscrew in a stowed and extended configuration.

The invention may also include a method for using a 1000 Plug-Removing Tool to remove a 1700 plug from an opening of a 1600 container comprising partially inserting a 1200 helicoid tool of the 1000 Plug-Removing Tool into the plug, extending a 1300 lever of the 1000 Plug-Removing Tool, gripping the 1300 lever with a hand and using the 1300 lever to apply a torque relative to a point where the 1200 helicoid tool was inserted into the 1700 plug driving the 1200 helicoid tool into the 1700 plug, and using the 1000 Plug-Removing Tool, with the 1200 helicoid tool fully inserted into the 1700 plug, to pull the 1700 plug from the 1600 container. In addition, the method may include attaching a 1500 support tool of the 1000 Plug-Removing Tool to a rigid surface of the 1600 container such that the 1500 support tool is used as a fulcrum when using the 1000 Plug-Removing Tool to pull the 1700 plug from the 1600 container. The 1300 lever may be extended to about a right angle relative to a 1100 base of the 1000 Plug-Removing Tool. The method may be applicable when the 1600 container is a 1600 bottle, the 1700 plug is a cork, and the 1200 helicoid tool is a corkscrew.

DETAILED DESCRIPTION OF THE INVENTION

The following describes the details of the invention. Although the following description will proceed with reference being made to illustrative embodiments, many alternatives, modifications, and variations thereof will be apparent to those skilled in the art. Accordingly, it is intended that the claimed subject matter be viewed broadly. Examples are provided as reference and should not be construed as limiting. The term "such as" when used should be interpreted as "such as, but not limited to."

FIG. 1 illustrates the 1000 Plug-Removing Tool in the extended configuration. The 1000 Plug-Removing Tool includes a 1100 base, a 1200 helicoid tool, and a 1300 lever. In addition the 1000 Plug-Removing Tool may include ancillary features such as a 1500 support tool and a 1400 knife. The 1100 base is formed from a 1110 top surface, a 1120 bottom surface opposite the 1110 top surface, a 1140 first side surface, a 1130 second side surface opposite the 1140 first side surface, a 1150 first end, and a 1160 second end opposite the 1150 first end. The various surfaces are joined at their interfaces to form the 1100 base into a mostly solid structure with cutouts to hold the 1300 lever, 1200 helicoid tool, 1500 support tool, and 1400 knife. The 1100 base may be made from wood, metal, polymer, a composite material, or any other material sufficient to form the 1100 base. The 1100 base may be made using a molding, machining, extruding, stamping, or an additive manufacturing process such as 3D printing.

Figure 2:
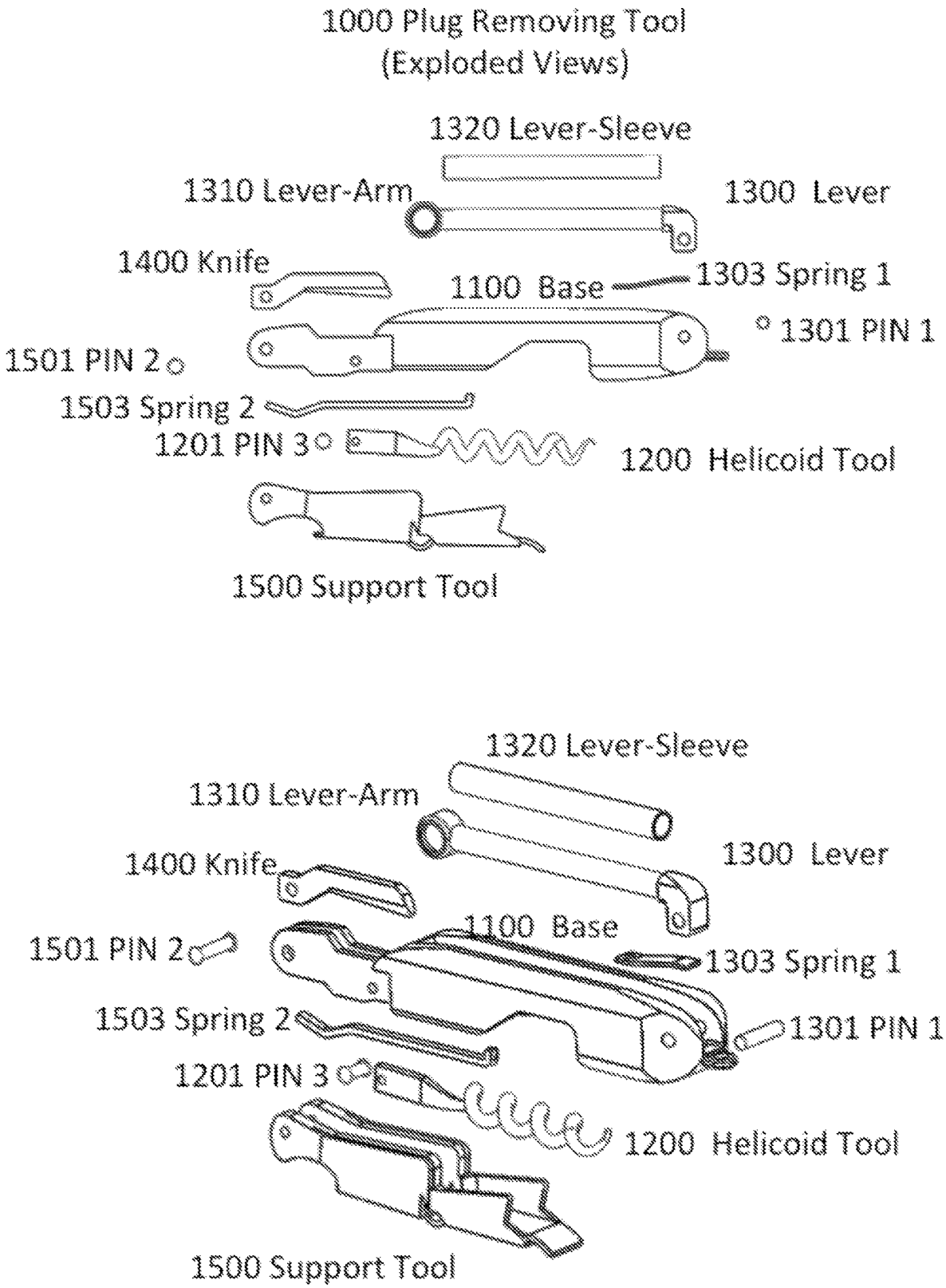
FIG. 2 is a diagram of an exemplary embodiment illustrating an exploded view of the Plug-Removing Tool in accordance with the teachings of the present invention.
Figure 3:
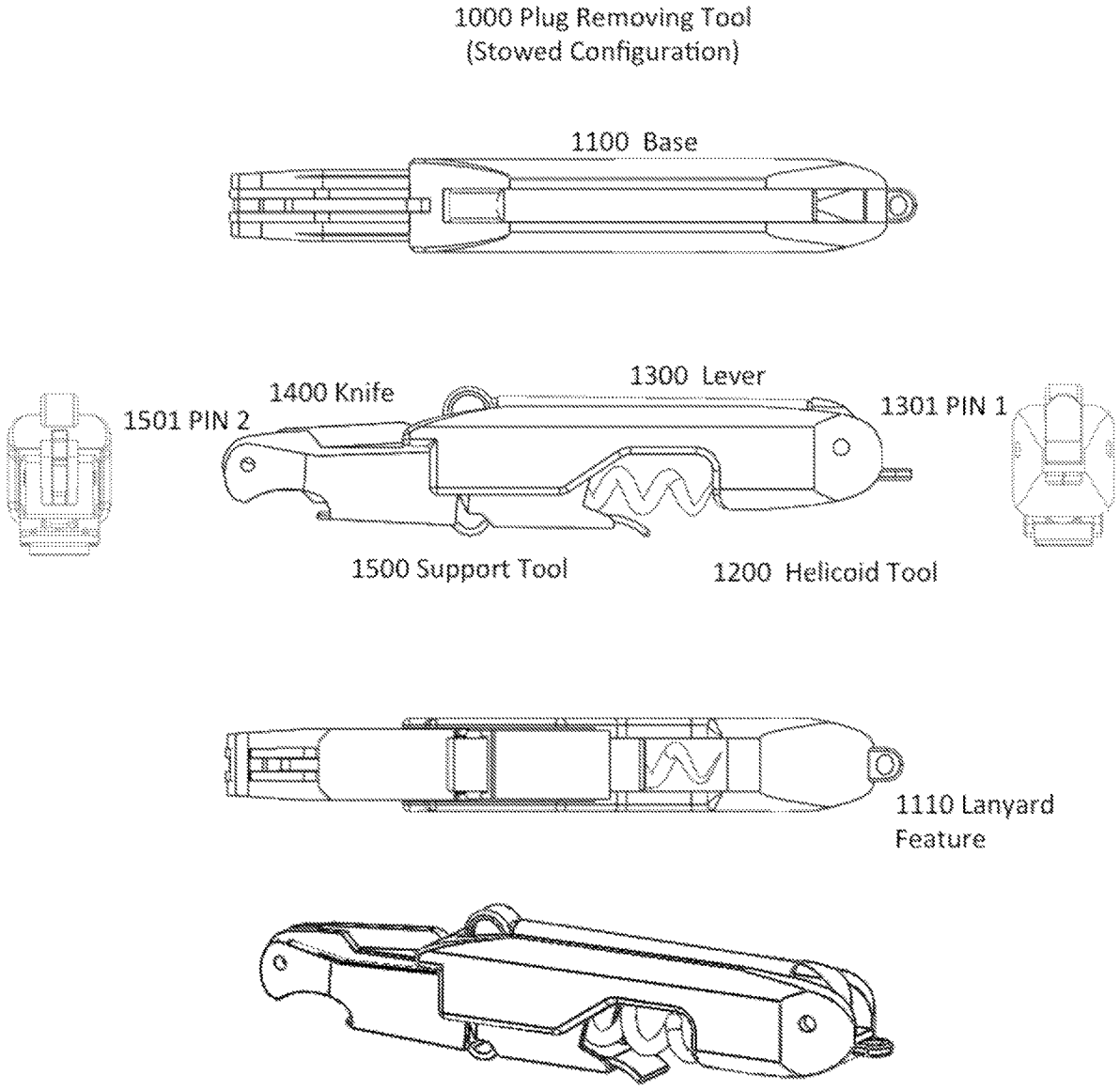
FIG. 3 is a diagram illustrating the Plug-Removing Tool in the stowed configuration in accordance with the teachings of the present invention.
Figure 4:
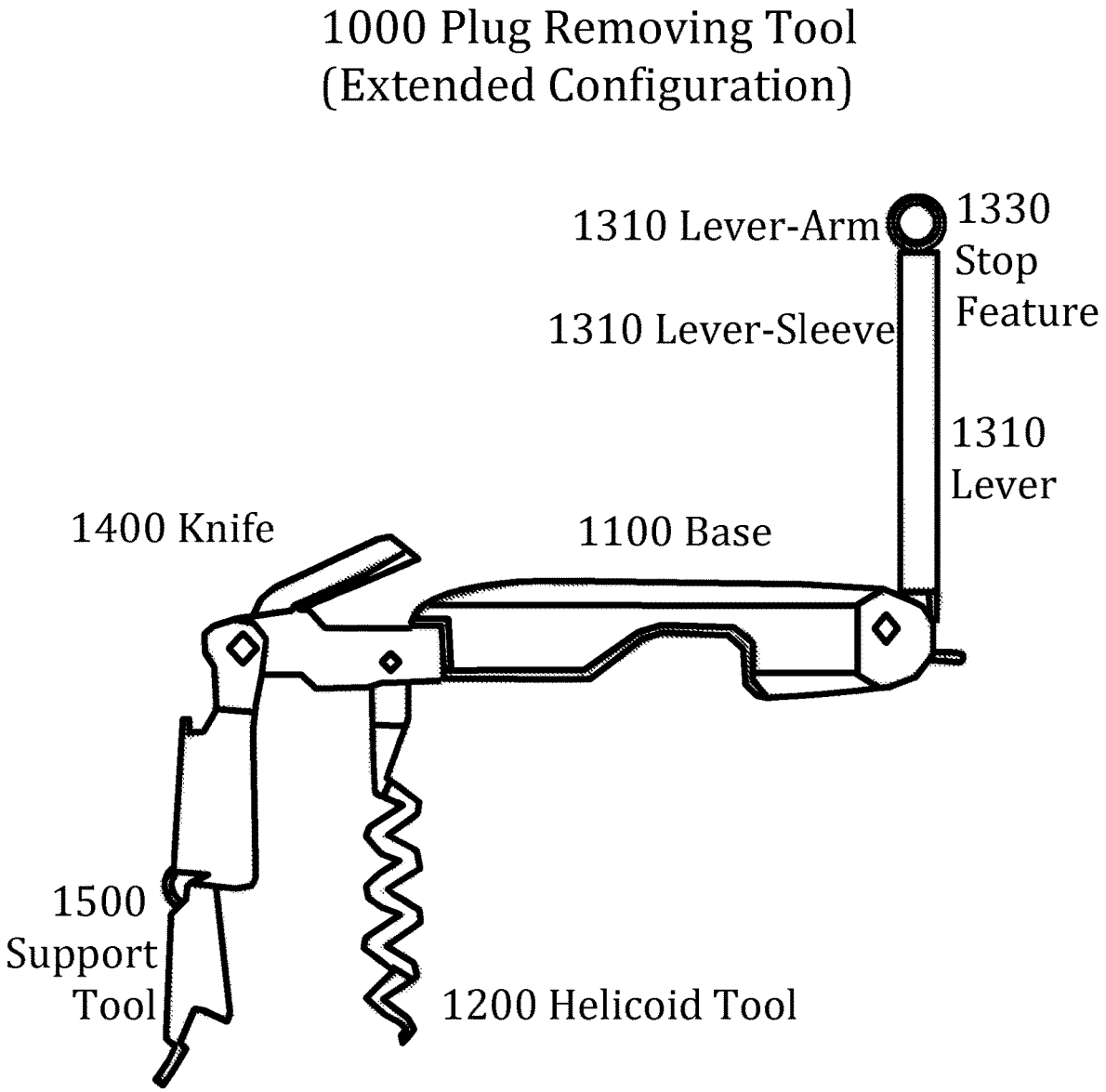
FIG. 4 is a diagram of an exemplary embodiment illustrating the Plug-Removing Tool shown as a side view when in the extended configuration in accordance with the teachings of the present invention.

FIG. 2 illustrates exploded views of the 1000 Plug-Removing Tool. The 1000 Plug-Removing Tool includes the 1100 base, a 1200 helicoid tool attached on a 1120 bottom surface of the 1100 base and near a 1160 second end of the 1100 base, and a 1300 lever attached on a 1110 top surface of the 1100 base, the 1110 top surface of the 1100 base opposite to the 1120 bottom surface of the 1100 base, and at a 1150 first end of the 1100 base. The 1200 helicoid tool and the 1300 lever may be pivotally attached to the 1100 base enabling the 1200 helicoid tool and the 1300 lever to be positioned in a stowed position (e.g. as shown in FIG. 3) when not in use and positioned in an extended position when in use (e.g. as shown in FIG. 4). The 1000 Plug-Removing Tool may further include a 1500 support tool pivotally attached on the 1120 bottom surface of the 1100 base and near the 1160 second end of the 1100 base enabling the 1500 support tool to be positioned in a stowed position (e.g. as shown in FIG. 3) when not in use and positioned in an extended position when in use (e.g. as shown in FIG. 4). The 1000 Plug-Removing Tool may further comprise a 1400 knife pivotally attached on the 1110 top surface of the 1100 base and near the 1160 second end of the 1100 base enabling the 1400 knife to be positioned in a stowed position (e.g. as shown in FIG. 3) when not in use and positioned in an extended position when in use (e.g. as shown in FIG. 4). The 1000 Plug-Removing Tool may also include a lanyard feature enabled to attach to a lanyard or key chain to make it easy to carry the 1000 Plug-Removing Tool. The support tool further comprises a channel with a first end connected to the base and having a second end with angular grooves.

The 1300 lever may also include a 1310 lever-arm and a 1320 lever-sleeve. The 1150 first end of the 1310 lever-arm may be pivotally attached to the 1100 base with a pin enabling the 1300 lever to rotate from a stowed configuration (e.g. as shown in FIG. 3) into an extended configuration (e.g. as shown in FIG. 4), the extended configuration with the 1300 lever forming about a right angle relative to the 1100 base, and a 1160 second end of the 1310 lever-arm including a stop feature to hold the 1320 lever-sleeve. The 1320 lever-sleeve may also be configured to rotate freely about the 1310 lever-arm. The 1310 lever-arm arm comprises a 1150 first end that includes a mating feature that is assembled to the 1100 base. The 1160 second end of the 1310 lever-arm includes a protrusion that acts as a holding feature to hold the 1320 lever-sleeve in place. A cylindrical shaft separates the 1150 first end of the 1310 lever-arm from the 1160 second end of the 1310 lever-arm. The 1320 lever-sleeve may be an annular cylinder assembled around the shaft of the 1310 lever-arm. The 1320 lever-sleeve may be assembled loosely about the shaft of the 1310 lever-arm such that the 1320 lever-sleeve spins around the 1310 lever-arm.

The 1000 Plug-Removing Tool may also include a 1303 first spring configured to hold the 1300 lever and a 1503 second spring configured to hold the 1200 helicoid tool in the stowed and the extended configuration.

Figure 5:
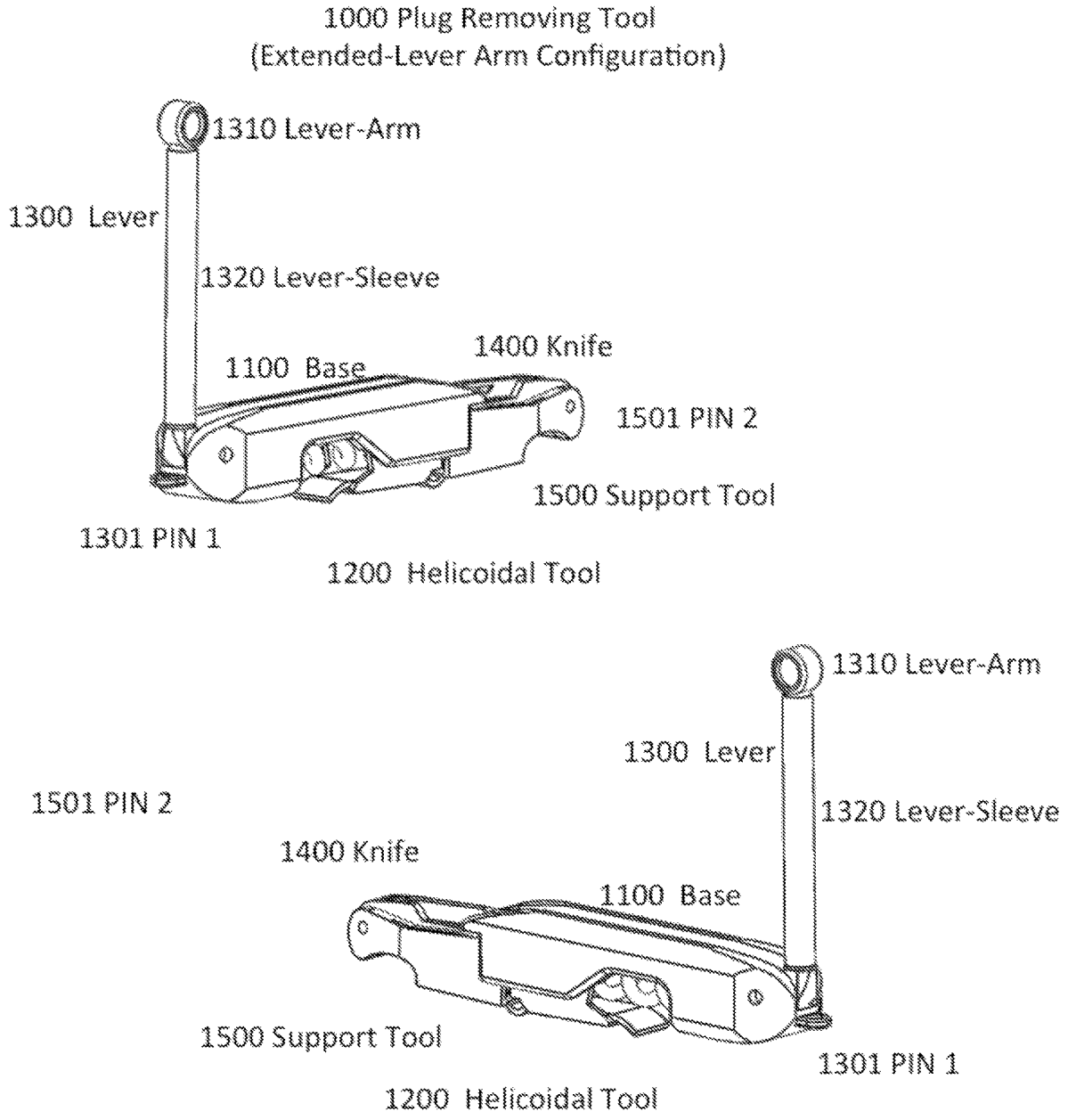
FIG. 5 is a diagram of an exemplary embodiment illustrating the Plug-Removing Tool with the lever arm in the extended configuration in accordance with the teachings of the present invention.
Figure 6:
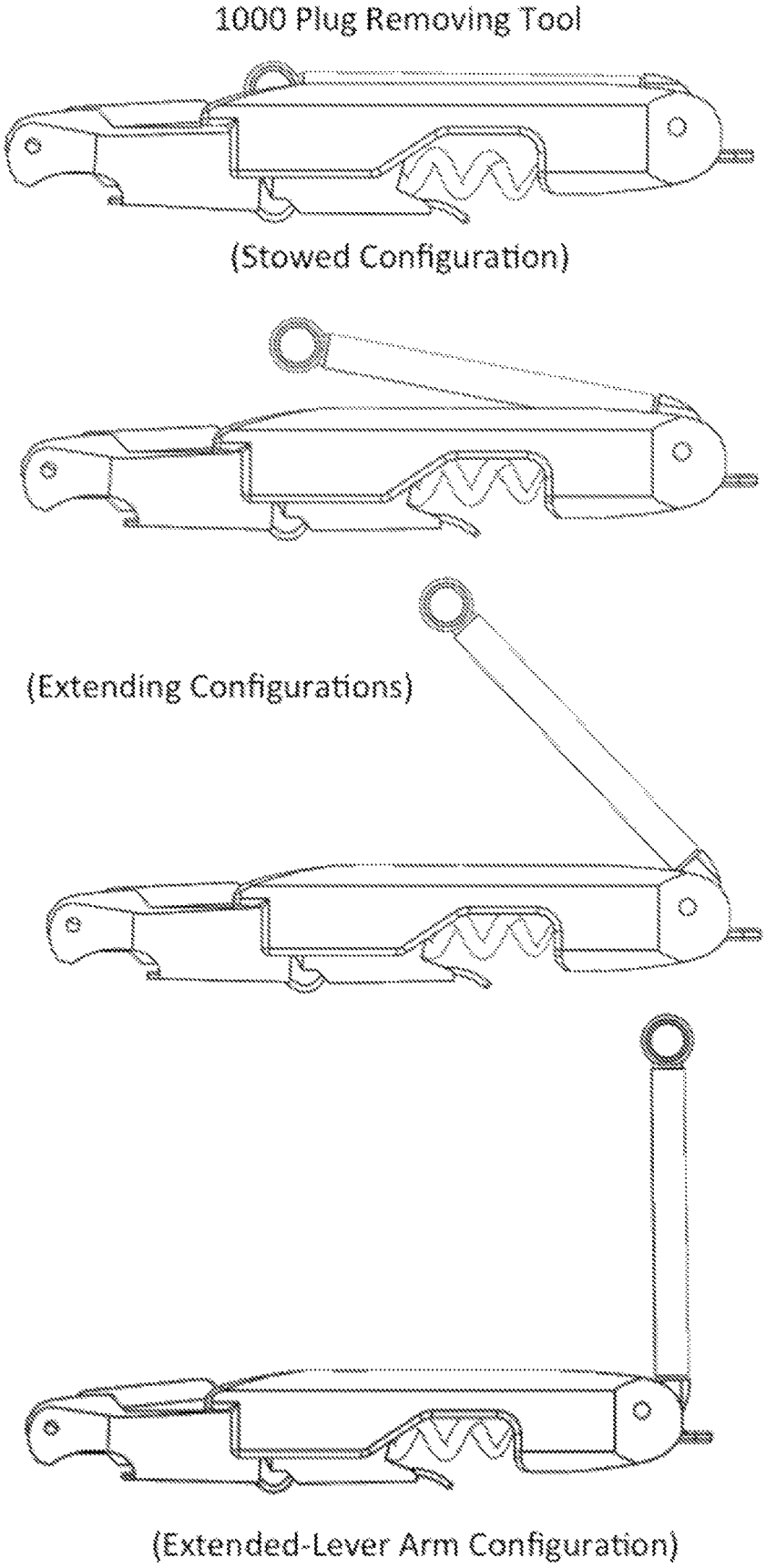
FIG. 6 is a diagram of an exemplary embodiment illustrating the Plug-Removing Tool with the lever arm in the stowed configuration, extending configuration, and the extended configuration in accordance with the teachings of the present invention.

FIGS. 5 and 6 show the 1000 Plug-Removing Tool with the 1310 lever-arm. In the stowed configuration the 1310 lever-arm fits snug within the 1100 base. There is enough of the 1000 Plug-Removing Tool exposed from the 1100 base such that the 1300 lever can be rotated out into the extended configuration. The 1300 lever may be pulled and rotated about a pin holding the 1150 first end of the 1310 lever-arm to the 1100 base. The 1300 lever may be rotated until it forms about a right angle to the 1100 base.

Figure 7:
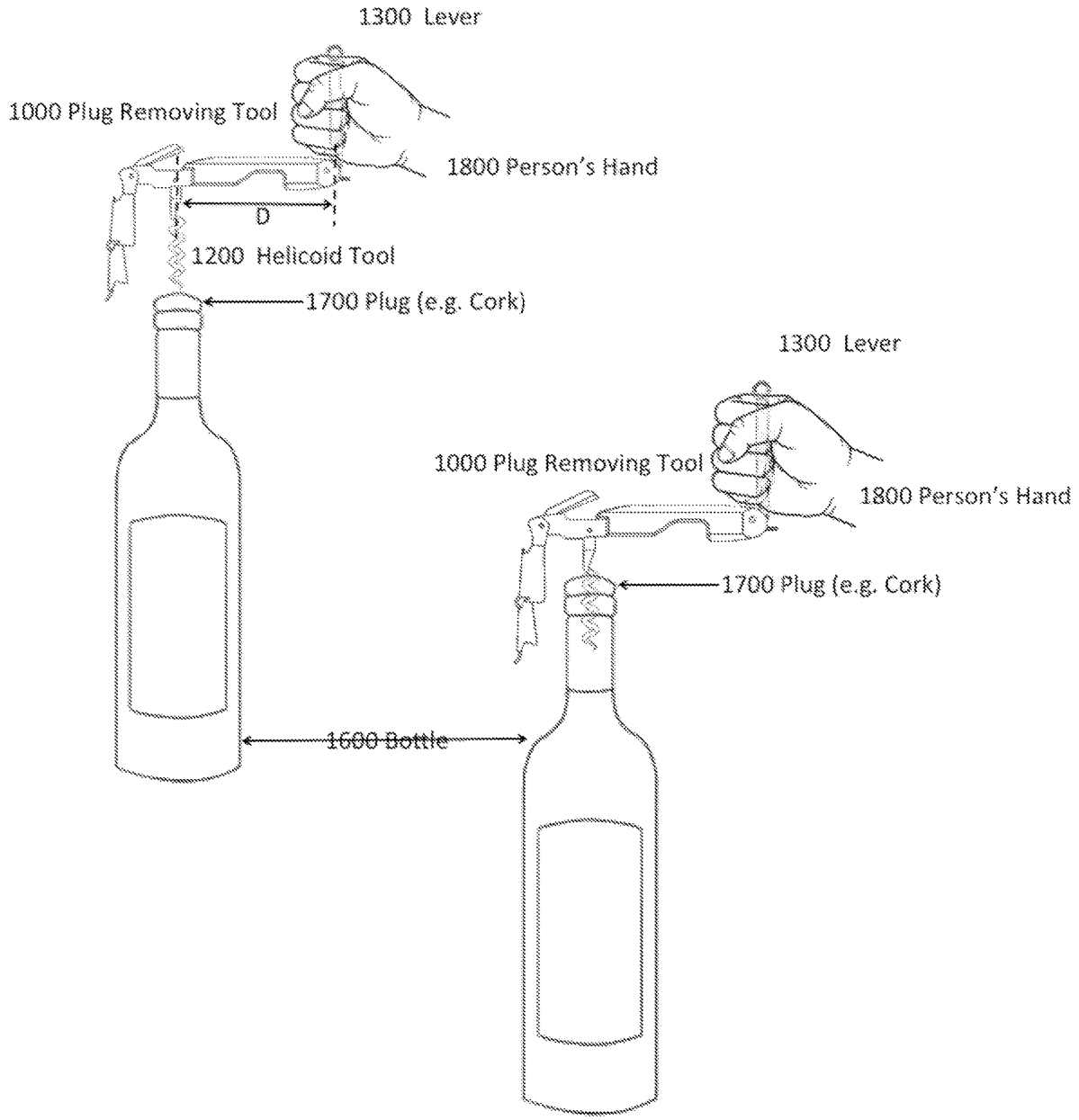
FIG. 7 is a diagram of an exemplary embodiment illustrating the Plug-Removing Tool used to remove a cork from a bottle in accordance with the teachings of the present invention.

FIG. 7 shows the 1000 Plug-Removing Tool being used by a person to remove a 1700 cork from a 1600 bottle. To remove a 1700 plug (e.g. the cork) from an opening of a 1600 container (e.g. the 1600 bottle), a person starts by partially inserting a 1200 helicoid tool (e.g. the corkscrew) of the 1000 Plug-Removing Tool into the 1700 plug. Next the person extends the 1300 lever of the 1000 Plug-Removing Tool and grips the 1300 lever with one hand and the 1600 bottle with the other hand. The person then uses the 1300 lever to apply a torque relative to a point where the 1200 helicoid tool was inserted into the plug driving the 1200 helicoid tool into the 1700 plug. As the person rotates the 1300 lever, the 1320 sleeve spins around the 1300 lever 1310 arm enabling the 1200 helicoid tool to be inserted into the 1700 plug. Instead of turning the 1100 base at the point of the 1200 helicoid tool, the use of the 1300 lever amplifies the mechanical 1300 leverage. For example, the torque applied to insert the 1200 helicoid is equal to the force applied by the person's hand multiplied by the distance (D) between the 1200 helicoid tool and the 1300 lever. The person then uses the 1000 Plug-Removing Tool, with the 1200 helicoid tool fully inserted into the 1700 plug, to pull the 1700 plug from the 1600 container. Alternatively, a 1500 support tool of the 1000 Plug-Removing Tool may be applied to a rigid surface of the 1600 container such that the 1500 support tool is used as a fulcrum when using the 1000 Plug-Removing Tool to pull the 1700 plug from the 1600 container.

The use of the 1000 Plug-Removing Tool transfers the load from the person's wrist to the person's 1310 arm and shoulder. This makes it easier for the person to apply the needed force to fully insert the 1200 helicoid tool into the 1700 plug, since the person's arm and shoulder muscles are larger and stronger than the wrist muscles. The person may also be able to insert the 1200 helicoid tool faster since the person's arm and shoulder muscles are stronger and the 1000 Plug-Removing Tool can be rotated at a higher angular velocity. Further the person is less likely to sustain injuries (e.g. carpal tunnel syndrome and muscle and joint strains) since the stress from applying the force is distributed from just the wrist to the larger arm and shoulder muscles.

The terms and expressions, which have been employed herein, are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed:

1. A plug-removing tool comprising:

a base including a top surface, a bottom surface opposite the top surface, a first side surface, a second side surface opposite the first side surface, a first end, and a second end opposite the first end; a helicoid tool attached on the bottom surface of the base and near the second end of the base; and a knife to be hinged into a stowed position when not in use and hinged into an extended position when in use;

a support element pivotally attached on the bottom surface of the base and near the second end of the base enabling the support tool to be hinged into a stowed position when not in use and hinged into an extended position when in use;

a lever attached on the top surface of the base and at the first end of the base, wherein a first end of the lever is pivotally attached to the base enabling the lever to rotate from a stowed configuration into an extended configuration with the lever forming a right angle relative to the base;

wherein raising the lever provides a capacity to apply a torque relative to the helicoid tool for driving the helicoid tool into a plug with full continuous turns of the helicoid tool.

2. The plug-removing tool of claim 1 wherein the helicoid tool and the lever are pivotally attached to the base enabling the helicoid tool and the lever to be hinged into a stowed position when not in use and hinged into an extended position when in use.

3. The plug-removing tool of claim 2 wherein a first spring is configured to hold the lever and a second spring is configured to hold the helicoid tool in the stowed and the extended configuration.

4. The plug-removing tool of claim 1 wherein the support element further comprises a tool including a channel with a first end connected to the base and having a second end with angular grooves.

5. The plug-removing tool of claim 1 wherein the lever comprises an arm and a sleeve.

6. The plug-removing tool of claim 5 wherein the sleeve is configured to rotate freely about a shaft of the arm.

7. A cork-removing tool comprising: a base including a top surface, a bottom surface opposite the top surface, a first side surface, a second side surface opposite the first side surface, a first end, and a second end opposite the first end; a knife pivotally attached on the top surface of the base and at the second end of the base enabling the knife to be positioned in a stowed position when not in use and positioned in an extended position when in use; a support element pivotally attached on the bottom surface of the base and near the second end of the base enabling the support tool to be hinged into a stowed position when not in use and hinged into an extended position when in use;

a corkscrew tool attached on the bottom surface of the base and near the second end of the base; and a lever pivotably attached on the top surface of the base and at the first end of the base.

8. The cork-removing tool of claim 7 wherein the corkscrew and the lever are pivotally attached to the base enabling the corkscrew and lever to be positioned in a stowed position when not in use and positioned in an extended position when in use.

9. The cork-removing tool of claim 8 wherein the lever comprises an arm and a sleeve wherein a first end of the arm is pivotally attached to the base enabling the lever to rotate from a stowed configuration into an extended configuration with the lever capable of forming a right angle relative to the base, and a second end of the arm including a stop feature to hold the sleeve, and the sleeve is configured to rotate freely about the arm.

10. The cork-removing tool of claim 7 wherein the the support element further comprises a tool including a channel with a first end connected to the base and having a second end with angular grooves.

11. The cork-removing tool of claim 10 wherein a first spring is configured to hold the lever and a second spring is configured to hold the corkscrew in a stowed and extended configuration.

* * * * *